US005184871A

United States Patent [19]

LaPointe et al.

[11] Patent Number: 5,184,871

[45] Date of Patent: Feb. 9, 1993

[54] DETACHABLE CHAIR BACK

[75] Inventors: Larry P. LaPointe, Temperance; Edwin J. Shoemaker, Monroe, both of Mich.

[73] Assignee: La-Z-Boy Chair Co., Monroe, Mich.

[21] Appl. No.: 816,849

[22] Filed: Jan. 2, 1992

Related U.S. Application Data

[63] Continuation of Ser. No. 621,239, Nov. 30, 1990, abandoned.

[51] Int. Cl.[5] ..... A47C 7/00

[52] U.S. Cl. ..... 297/444; 297/440; 74/527; 403/374

[58] Field of Search ..... 297/353, 444, 440, 443; 248/412, 231.3; 403/374, 95, 106; 74/527; 24/585, 647, 650

[56] References Cited

U.S. PATENT DOCUMENTS

| | | | |
|---|---|---|---|
| 553,386 | 1/1896 | Blair | 297/444 |
| 1,695,101 | 12/1928 | Hoffman . | |
| 2,650,657 | 9/1953 | Ohlsson . | |
| 2,739,748 | 3/1956 | Hoover | 248/231.3 X |
| 2,849,249 | 8/1958 | Fridolph | 248/412 X |
| 3,525,549 | 8/1970 | Knabusch et al. | 297/353 X |
| 3,989,298 | 11/1976 | Cycowicz | 297/342 |
| 4,082,355 | 4/1978 | Knabusch et al. | 297/440 |
| 4,614,007 | 9/1986 | Else | 403/374 X |
| 4,635,611 | 1/1987 | Priebe | 24/585 X |
| 4,850,646 | 7/1989 | Wieland | 297/444 |

FOREIGN PATENT DOCUMENTS

| | | | |
|---|---|---|---|
| 9970 | 8/1886 | United Kingdom | 248/412 |

OTHER PUBLICATIONS

La-Z-Boy Product Information and Warranty Information Form #60, Apr. 1989.

*Primary Examiner*—Peter R. Brown
*Assistant Examiner*—Milton Nelson, Jr.
*Attorney, Agent, or Firm*—Harness, Dickey & Pierce

[57] ABSTRACT

An improved locking mechanism for detachably securing a seat back to a chair frame is disclosed. The improved locking mechanism includes a pair of side brackets secured to opposite sides of the seat back. Linkage supported from the chair frame are provided for receiving the slide brackets thereon for supporting the seat back on the chair frame in a predetermined orientation relative to the seat member. A moveable locking arm is supported from the slide brackets and includes an offset arcuate cam surface which is adapted to engage an arcuate notch formed on the linkage when the locking arm is moved to a locked position. The mating engagement of the arcuate offset cam surface within the arcuate notch generates a line-of-contact therebetween which inhibits relative movement between the slide brackets and the upstanding links for rigidly securing seat member to the chair frame. An alternative embodiment discloses a modified link member which is adapted to create an interference engagement with the slide bracket to augment the locking action of the arcuate cam surface within the arcuate notch.

13 Claims, 3 Drawing Sheets

FIG 1A
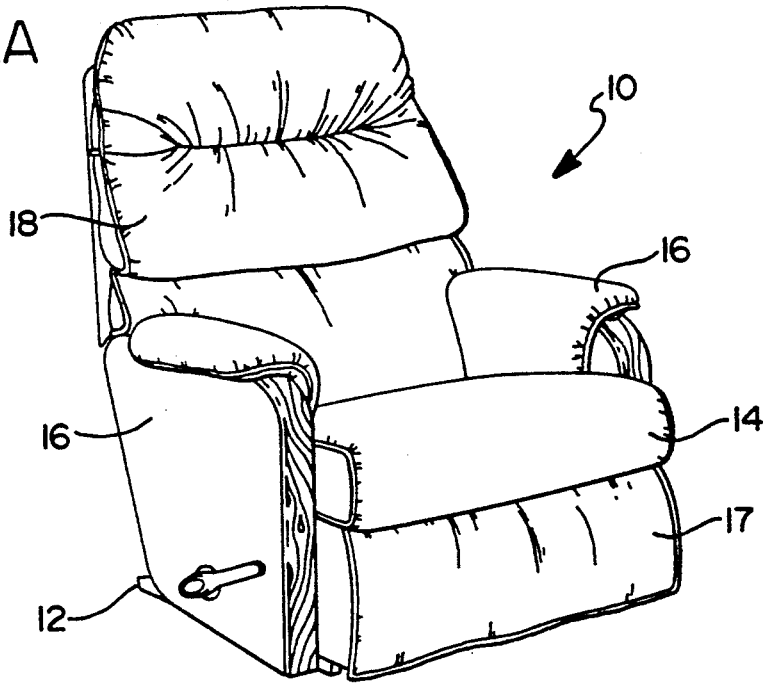
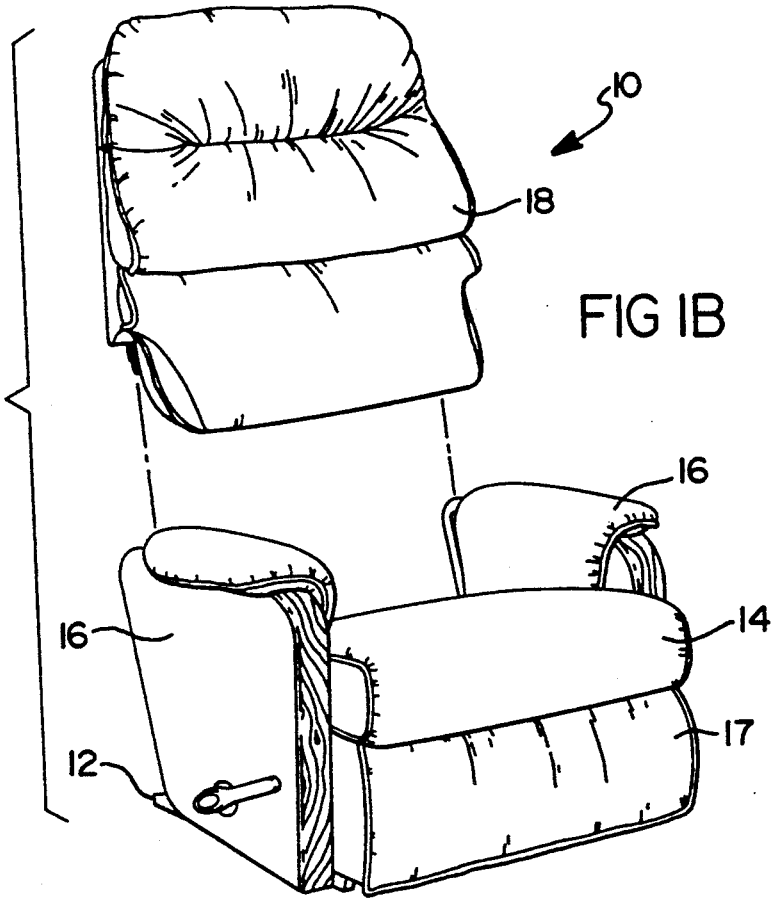
FIG 1B

DETACHABLE CHAIR BACK

This is a continuation of U.S. Pat. application Ser. No. 07/621,239, filed Nov. 30, 1990.

BACKGROUND OF THE INVENTION

The present invention relates generally to articles of furniture and, more particularly, to an improved locking mechanism for detachably securing a seat back relative to a seat member.

It is known in the furniture industry to install detachable seat back members on chairs, sofas and the like to facilitate more efficient storage and shipment. More particularly, detachable seat backs are primarily used on reclining-type chairs which typically have high seat back members. One example of a reclining chair having a detachable seat back is disclosed in U.S. Pat. No. 3,525,549 which illustrates the use of slide brackets mounted on each side of the seat back that are insertable over upstanding swing links mounted on opposite sides of the chair. A locking arm is pivotably supported from each of the slide brackets for movement between a "released" position to a "locked" position. In the "locked" position, a cam surface formed on the locking arm lockingly engages a rectangular notch formed on the upstanding swing links for latching the slide brackets and, in turn, the seat back to the chair. In addition, U.S. Pat. No. 4,082,355 discloses a similar locking mechanism for detachably securing a seat back to a seating unit of a upholstered sofa.

While conventional locking mechanisms generally perform satisfactorily, an undesirable "squeaking" or "rattling" noise may occur upon the seat occupant applying or removing pressure from the seat back. This undesirable noise is caused by pivotal or "rocking" movement of the locking arm cam surface relative to the rectangular notch which generates audible metal-to-metal contact between the slide brackets and the upstanding swing links.

SUMMARY OF THE INVENTION

Accordingly, it is a primary object of the present invention to provide an improved locking mechanism for detachably securing a seat back in a predetermined relation to a seat member while substantially eliminating any undesirable noise.

It is another object of the present invention to provide a locking mechanism which is moveable between the first "locked" position for firmly securing the seat back in fixed relation to the seat member, and the second "released" position for detachably removing the seat back for convenient storage during shipment.

In accordance with a preferred embodiment, an improved detachable chair back mechanism is disclosed having arcuate cam surfaces associated with both the locking arm and the notch on the upstanding links. Mating engagement of the arcuate cam surfaces creates a downwardly directed force upon movement of the locking arm toward the "locked" position for causing an interference or frictional engagement between the slide brackets and an edge surface of the swing links. This engagement augments the locking action produced by the mating engagement of the arcuate cam surface on the locking arm within the arcuate notch on the swing links. As such, "rocking" movement between the components is substantially eliminated while providing greater rigidity between the seat back and the seat member. Moreover, the interference engagement is designed to permit simple and easy removal of the detachable seat back upon movement of the locking arm to the "released" position.

Further objects and advantages of the present invention will be apparent from the following description, reference being made to the accompanying drawings wherein preferred embodiments of the present invention are clearly shown.

BRIEF DESCRIPTION OF THE DRAWINGS

FIG. 1A is a pictorial view of a chair with the seat back firmly secured in fixed relation to a seat member;

FIG. 1B is a pictorial view, similar to FIG. 1A, showing the seat back releasably detached from the chair;

DESCRIPTION OF THE PREFERRED EMBODIMENTS

Figure 2:
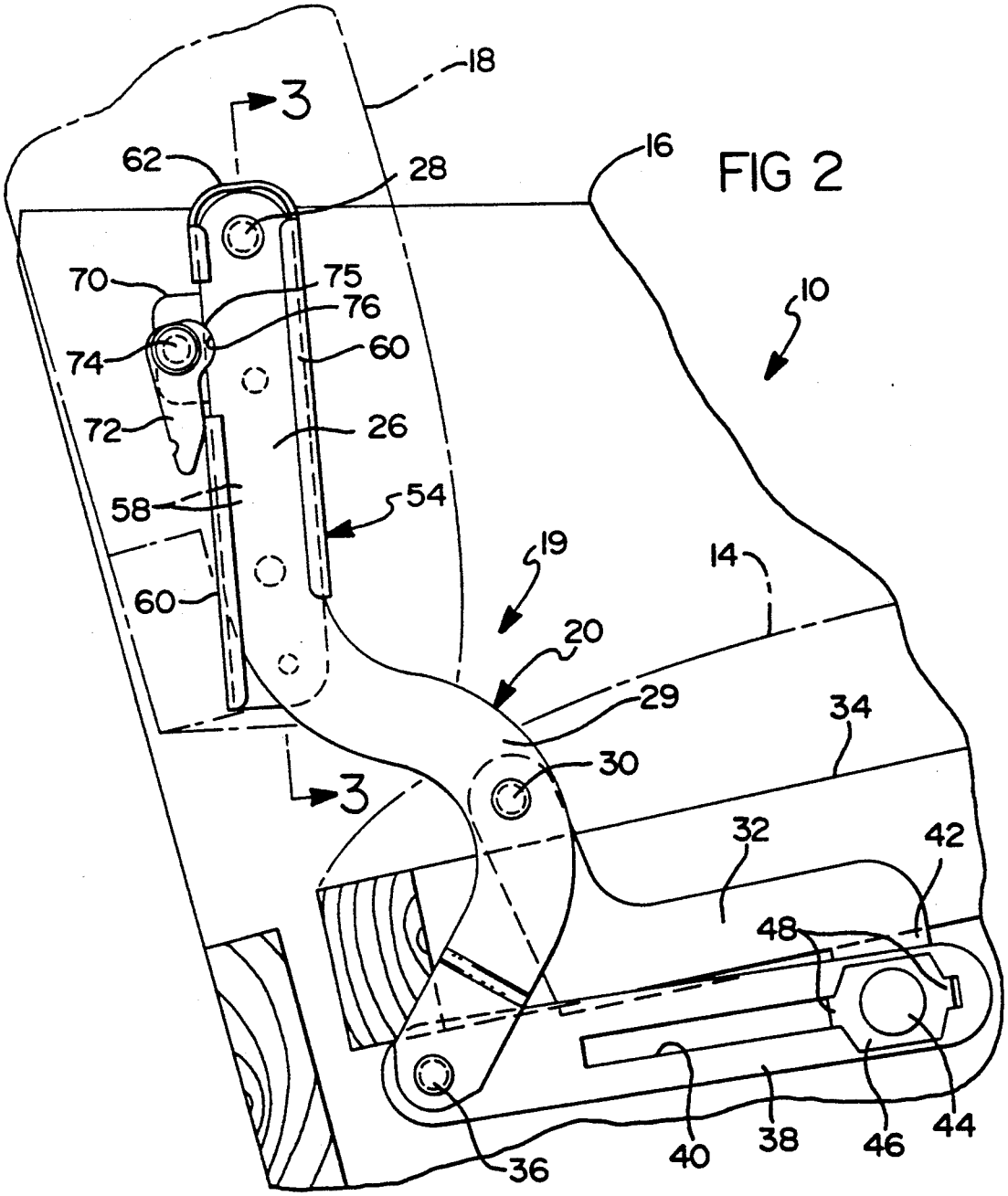
FIG. 2 is an enlarged view of the components associated with an improved locking mechanism incorporated into the chair according to a first preferred embodiment of the present invention.
Figure 3:
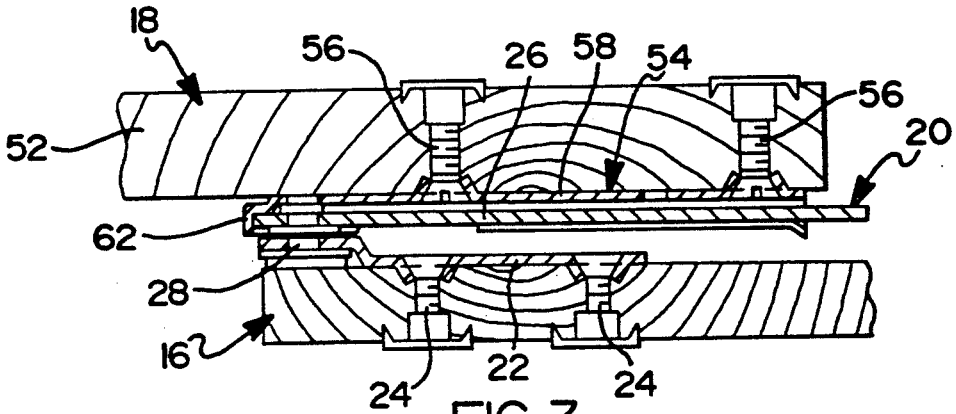
FIG. 3 is a cross-sectional view taken along line 3—3 of FIG. 2.
Figure 4:
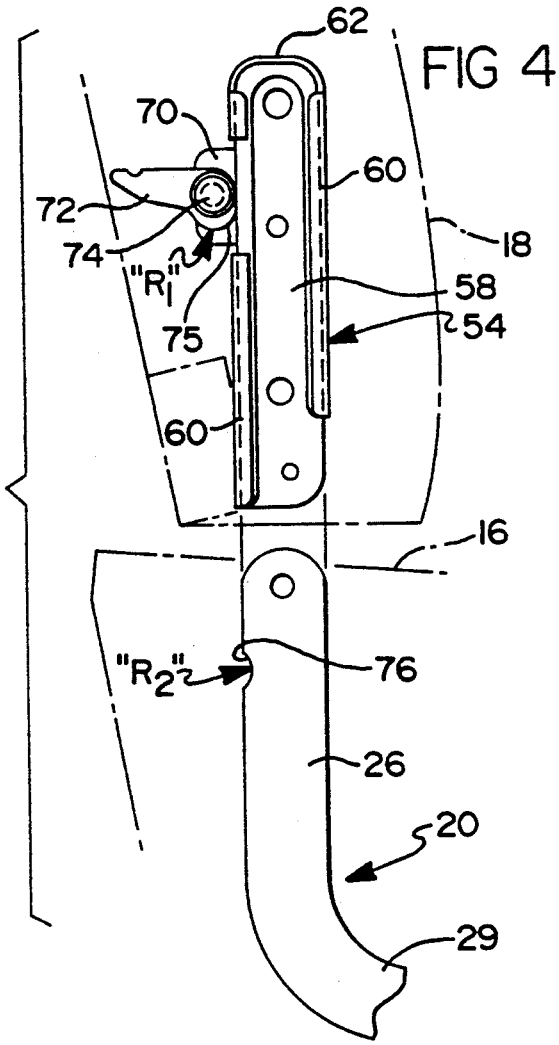
FIG. 4 is a partial broken view of the structure illustrated in FIG. 2 with the seat back shown in a "released" detached position with respect to the seat member.
Figure 5:
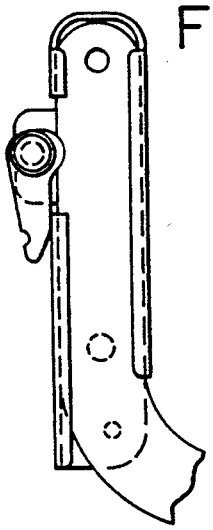
FIG. 5 is a view, similar to FIG. 4, showing the operative interaction of the various components of the improved locking mechanism in a "locked" position.

With particular references to the drawings, an exemplary chair 10 is shown to include a base 12, an upholstered seat member 14, a pair of upholstered side arms 16 and an extensible leg rest assembly 17. An upholstered seat back 18 rests upon seat member 14 between side arms 16 and is adapted to be releasably secured to chair 10 in a predetermined orientation with respect to seat member 14 as best seen in FIG. 1A. As will be described hereinafter, an improved locking mechanism is incorporated into chair 10 for permitting seat back 18 to be releasably detached from chair 10 for convenient storage and shipment (FIG. 1B). While the embodiments to be described hereinafter illustrate the improved locking mechanism incorporated into a reclining chair, it will be appreciated that the present invention can also be used with other suitable articles of furniture such as non-reclining chairs, sofas, loveseats and the like.

With particular reference now to FIGS. 2 through 5, a first preferred embodiment of the improved locking mechanism for detachably securing seat back 18 to chair 10 is shown in greater detail. More particularly, a linkage assembly 19 is provided for permitting reclining movement of seat back 18 and seat member 14 relative to base 12. Linkage assembly 19 includes an S-shaped swing link 20 pivotably secured to an inner face of side arm 16 via a connector link 22 which is secured to side arm 16 by fasteners 24. More particularly, upstanding end 26 of swing link 20 is pivotally secured to the top end of connector link 22 about pivot 28. A curved central portion 29 of swing link 20 is connected about pivot 30 to seat bracket 32. Seat bracket 32 is secured to one side of a frame portion 34 of seat member 14 in a conventional manner. As will be appreciated, swing link 20, connector link 22 and seat bracket 32 are also provided on the opposite side of seat member 14 to define substantially identical left and right hand linkage assemblies 19.

As best seen in FIG. 2, the lower end of swing link 20 is secured about pivot 36 to a laminated link member 38 which has an elongated slot 40 formed therein. Seat bracket 32 has a downwardly extending end portion 42 having an aperture through which a bolt 44 extends. Bolt 44 has an annular washer 46 concentrically supported thereon having a pair of fingers 48 which extend transversely within slot 40. As seen in FIG. 2 of U.S. Pat. No. 3,525,549, the specification and drawings of which are expressly incorporated by reference herein, annular spacers made of plastic or like material are interposed between the laminations and the outer faces of link 38. Likewise, a biasing spring and a wing nut are applied to the threaded end of bolt 44 so that variable pressure can be applied between downwardly extending end 42 and the lamination of link member 38 for regulating the amount of force required to move and retain seat back 18 through a predetermined range of "reclined" positions.

The opposite sides of frame 52 for seat back 18 each have a slide bracket 54 secured thereto by screw fasteners 56 in a conventional manner. Slide brackets 54 include a web portion 58, inwardly presenting channel sections 60 extending along their longitudinal sides, and top channel section 62 configured to generally follow the shape of upstanding end portions 26 of swing links 20. Top channel section 62 limits the downward movement of slide brackets 54 relative to swing links 20. With this arrangement, the slide brackets 54 secured to opposite sides of seat back 18 may be inserted on and moved downwardly over upstanding ends 26 of swing links 20. It will be appreciated that while swing link 20 is shown incorporated into a reclining linkage assembly 19, the present invention is adapted for use with other suitable reclining or non-reclining link members that are supported from side arms 16 or seat member 14 and which are adapted to receive slide brackets 54 thereon.

Web portion 58 has a flange 70 located below top channel section 62 which is 74. Locking arm 72 has an offset arcuate cam surface 75, generally defined by a first radius "$R_1$". Offset cam surface 75 is adapted to extend into and engage an arcuate notch 76 formed in an edge surface of upstanding end 26 of swing link 20 for clamping slide bracket 54 thereto and locking swing link 20 against endwise displacement. The arcuate surface of notch 76 is defined by a radius "$R_2$" which is substantially equal to, or slightly greater than, radius "$R_1$" of offset cam surface 75. Moreover, arcuate cam surface 75 is moveable from a "released" position (FIG. 4) to a "locked" position (FIG. 5) relative to arcuate notch 76 via pivotable movement of locking arm 72 about pivot 74. Preferably "$R_1$" and "$R_2$" are selected to permit relatively easy pivotal movement of locking arm 72 while providing a "line-of-contact" between offset cam surface 75 and notch 76. As such, offset cam surface 75 is designed to urge upstanding end 26 against an inner wall of an opposite side channel section 60 of slide bracket 54 when locking arm 72 is in the "locked" position for firmly securing slide bracket 54 and, in turn, seat back 18 to swing link 20.

Detachable seat back 18 permits chair 10 to be shipped as a two-piece unit, as illustrated in FIG. 1B. Thereafter, it is only necessary to lift seat back 18 and insert slide brackets 54 downwardly over upstanding ends 26 of swing links 20 to assembly seat back 18 on chair 10. Following assembly, downward pivotal movement of locking arms 72 acts to "clamp" slide brackets 54 in fixed relation with respect to upstanding ends 26 of swing links 20. This pivotal movement of locking arms 72 causes offset surfaces 75 to enter and matingly engage notches 76 of swing links 20 for firmly drawing the inner wall surface of the channel section 60 opposite to locking arms 72 against the opposite edge of swing link 20 along substantially entire length thereof. In addition, the mating "line-of-contact" engagement between offset arcuate cam surface 75 and arcuate notch 46 inhibits any upward or "rocking" movement of seat back 18 relative to swing link 20 when locking arm 72 is retained in the "locked" position.

Figure 7:
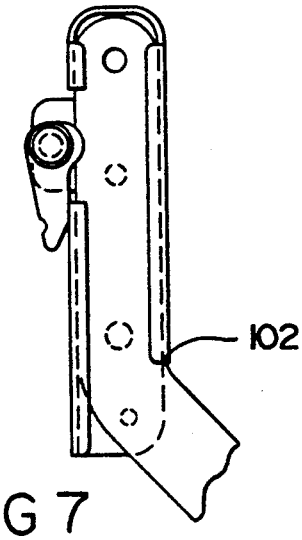
FIG. 7 illustrates the operative interaction of the various components of the locking mechanism of FIG. 6 in the "locked" position.
Figure 6:
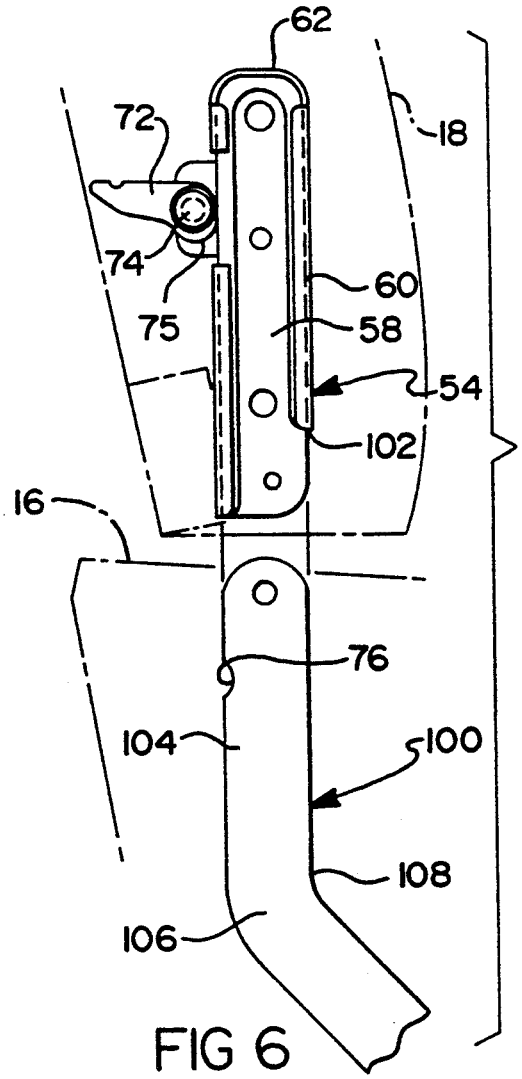
FIG. 6 is a view, similar to FIG. 4, illustrating an alternative preferred embodiment of an improved locking mechanism in accordance with the present invention.

With particular reference now to FIGS. 6 and 7, an alternative embodiment of the present invention is shown. More particularly, the alternative preferred embodiment is a modified version of the locking mechanism disclosed in reference to FIGS. 4 and 5. As such, like reference numerals are used to identify like components that have been previously described. The modified version of the locking mechanism includes utilization of a modified swing link 100 configured to provide an interference and/or frictional engagement with channel edge portion 102 of slide bracket 54 upon pivotally moving locking arm 72 to the "lock" position. The arcuate offset cam surface 75 on locking arm 72 and the arcuate notch 76 on upstanding ends 104 of swing link 100 are substantially identical to that previously disclosed. However, modified swing link 100 includes a slightly widened or tapered surface which is adapted to engage channel edge portion 102 of slide bracket 54 when slide bracket 54 is inserted over upstanding end 104 of swing link 100. Preferably, swing link 100 has a modified central curved portion 106 having an inner edge 108 such that upon slide bracket 54 being inserted over upstanding end 104 of swing link 100 and moved downwardly relative thereto, initial contact is made between channel edge portion 102 of slide bracket 54 and inner edge surface 108 of swing link 100. This initial contact occurs prior to arcuate shaped top sections 62 engaging the top edge surface of upstanding end 104 for limiting the downward travel of slide bracket 54 relative to swing link 100. Upon pivotal movement of lock arm 72 to the "locked" position, offset cam surface 75 matingly engages arcuate notch 76. This mating interaction creates a downward force acting to move sliding bracket 54 downwardly into a snug interference fit engagement between channel edge portion 102 of slide brackets 54 and edge surface 108 of swing links 100. In this manner, the modified locking mechanism of FIGS. 6 and 7 includes both lengthwise line-of-contact engagement and the transverse interference fit engagement between slide bracket 54 and swing link 100. Therefore, the potential "rocking" movement of slide bracket 54 with respect to swing link 100 upon the seat occupant applying or removing pressure from seat back 18 is substantially inhibited. As such, the present invention substantially eliminates "rattling" or "squeaking" noise herebefore associated with conventional locking mechanisms for detachable seat backs.

Those skilled in the art can now appreciate that the present invention provides a novel, yet economical and reliable locking mechanism which is an improvement over prior art locking mechanisms. It is to be understood that while this invention was described in connection with various inferred embodiments, many modifications can be made thereto without departing from the spirit of this invention after having the benefit of studying the specification, drawings and the following claims.

What is claimed is:

1. A chair having a base assembly, a chair frame supported on said base assembly, a seat member supported on said chair frame, a pair of upstanding links secured to opposite inner side surfaces of said chair frame, a detachable seat back having a pair of slide brackets with longitudinal edge channels and an upper transverse edge portion secured to opposite outer side surfaces thereof and which are adapted to slidingly receive said upstanding links therein for supporting said seat back on said chair frame in a predetermined orientation relative to said seat member, and a locking mechanism for releaseably locking said seat back to said upstanding links, said locking mechanism including a locking arm supported from each of said slide brackets and which is pivotably moveable from a first position for locking said seat back to said upstanding links to a second position for permitting movement of said seat back relative to said upstanding links, an improvement wherein said locking arms having an arcuate offset cam surface adapted to matingly engage an arcuate notch formed on said upstanding links when said locking arms are moved to said first position for defining a substantially continuous line of contact therebetween, said locking mechanism further including transverse interference engagement means for augmenting the locking action of said arcuate cam surface within said arcuate notch, whereby said transverse interference engagement means is operable upon moving said locking arms to said first position such that said slide brackets are urged to move downwardly relative to said upstanding links so as to cause a transverse interference engagement between a lower end of one of said edge channels of said slide brackets and a generally transversely extending edge surface of said upstanding links such that said transverse interference engagement limits downward movement of said slide brackets on said link members and prevents said upper transverse edge portion of said slide brackets from contacting said link members.

2. The chair of claim 1 wherein said arcuate notch is formed on a first elongated edge surface of said upstanding link.

3. The chair of claim 2 wherein said longitudinal edge channels of each of said slide brackets are adapted to receive an end portion of said upstanding link therein upon assembly of said seat back onto said chair frame, whereby movement of said locking arm to said first position causes said offset arcuate cam surface to move into a mating line of contact engagement with said arcuate notch for causing an opposite second elongated edge of said end portion of said upstanding link to contact a complimentary longitudinal edge channel of said slide bracket along substantially the entire length thereof so as to lockingly retain said seat member on said swing links.

4. The chair of claim 3 wherein said arcuate offset cam surface is defined by a first radius $R_1$ and wherein said arcuate notch is defined by a second radius $R_2$, said first radius $R_1$ and second radius $R_2$ being selected such that upon said locking arm being moved to said first position said mating engagement of said arcuate cam surface with said arcuate notch generates said line of contact therebetween for inhibiting pivotable movement of said slide bracket relative to said end portion of said upstanding link upon a seat occupant apply or removing pressure from said seat back.

5. A chair having a base assembly, a chair frame supported on said base assembly, a seat member supported on said chair frame, a detachable seat back, and a locking mechanism for releasably locking said seat back to said chair frame, said locking mechanism comprising:

a pair of slide brackets with longitudinal edge channel sections and an upper transverse edge portion secured to opposite sides of said seat back;

a pair of upstanding link members secured to opposite sides of said chair frame for receiving said slide brackets thereon so as to support said seat back on said chair frame in a predetermined orientation relative to said seat member; and locking means moveable between a first position for locking said seat back to said link members and a second position for permitting installation and removal of said seat back relative to said link members;

said locking means including an arcuate cam surface associated with said slide brackets which is adapted to matingly engage an arcuate notch formed on a first edge surface of said link members for defining a continuous line of contact therebetween when said locking means is moved to said first position, and interference engagement means for causing a transverse interference engagement between the lower portion of one of said edge channel sections of said slide brackets and a transverse portion of the corresponding edge surface of said link members such that said upper transverse edge portions of said slide brackets are prevented from contacting said link members, whereby said mating engagement of said arcuate cam surface within said arcuate notch and said interference engagement acts to inhibit pivotable movement of said slide brackets relative to said link members.

6. The detachable seat back of claim 1 wherein said slide brackets have a web portion between said longitudinal edge channel sections wherein said slide brackets are adapted to receive an upstanding end of said link members, and means for securing said web portion of said slide brackets to said opposite sides of said seat back.

7. The detachable seat back of claim 6 wherein said locking means includes a locking arm supported on said slide bracket for pivotable movement, and wherein said arcuate cam surface is an offset cam projection formed on said locking arm, said arcuate notch being formed in said first edge surface of said upstanding end of said link member.

8. The detachable seat back of claim 7 wherein upon said locking arm being pivotally moved to said first position said offset arcuate cam projection moves into mating engagement with said arcuate notch for causing an opposite second edge surface of said upstanding end of said link member to effect substantially complete contact with the corresponding longitudinal edge channel section of said slide bracket, whereby removal of said seat back from said chair frame is inhibited.

9. The detachable seat back of claim 8 wherein said arcuate cam surface is defined by a first radius $R_1$ and wherein said arcuate notch is defined by a second radius $R_2$, said first radius $R_1$ and said second radius $R_2$ being selected such that upon said locking arm being moved to said first position said mating engagement of said arcuate cam surface within said arcuate notch generates said line of contact therebetween.

10. The detachable seat back of claim 9 wherein said second edge surface is a front elongated edge of said upstanding end of said link member, said front elongated edge being forced into said corresponding longitudinal edge channel section of said slide bracket along the entire length thereof in firm fixed relation therewith by said pivotable movement of said offset arcuate cam surface into mating engagement with said arcuate notch.

11. The detachable seat back of claim 10 wherein said interference engagement means is operable for augmenting the locking engagement of said slide brackets with said link member upon movement of said locking arm to said first position, whereby said slide bracket is moved downwardly relative to said link member.

12. The detachable seat back of claim 11 wherein said interference engagement means is further adapted to cause frictional engagement of a lower end of one of said longitudinal edge channel sections of said slide bracket with a tapered surface of said link member which is located below said arcuate notch and adjacent to said transverse portion of said corresponding edge surface of said link member.

13. The detachable seat back of claim 12 wherein said frictional interference engagement occurs upon an inner lowermost surface of said corresponding longitudinal edge channel section of said slide bracket contacting a curved central portion of said link member upon downward movement of said slide bracket relative to said link member.

* * * * *

UNITED STATES PATENT AND TRADEMARK OFFICE

CERTIFICATE OF CORRECTION

PATENT NO. : 5,184,871

DATED : February 9, 1993

INVENTOR(S) : Larry L. LaPointe and Edwin J. Shoemaker

It is certified that error appears in the above-identified patent and that said Letters Patent is hereby corrected as shown below:

| | |
|---|---|
| In the Abstract | Line 4<br>"linkage" should be --Linkages--. |
| Column 3 | Line 47<br>After "is" insert --provided for supporting a locking arm 72 for pivotal movement about pivot--. |
| Column 4 | Line 10<br>After "offset" insert --cam--. |

Signed and Sealed this

Twenty-third Day of November, 1993

*Attest:*

Bruce Lehman

BRUCE LEHMAN

*Attesting Officer*

*Commissioner of Patents and Trademarks*